US008212751B2

(12) United States Patent
Hwang

(10) Patent No.: US 8,212,751 B2
(45) Date of Patent: Jul. 3, 2012

(54) FLAT PANEL DISPLAY AND DATA MULTI-MODULATION METHOD THEREOF

(75) Inventor: Jong Hee Hwang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 873 days.

(21) Appl. No.: 11/881,829

(22) Filed: Jul. 27, 2007

(65) Prior Publication Data

US 2008/0024398 A1 Jan. 31, 2008

(30) Foreign Application Priority Data

Jul. 28, 2006 (KR) ..... 10-2006-0071382

(51) Int. Cl.
*G09G 3/36* (2006.01)

(52) U.S. Cl. ..... 345/87; 345/93; 345/103

(58) Field of Classification Search ..... 345/60, 345/63, 76–77, 82, 87, 93, 103
See application file for complete search history.

(56) References Cited

U.S. PATENT DOCUMENTS

| | | | | |
|---|---|---|---|---|
| 6,259,424 | B1 * | 7/2001 | Kurogane | 345/93 |
| 2002/0142504 | A1 * | 10/2002 | Feldman et al. | 438/30 |
| 2003/0001810 | A1 * | 1/2003 | Yamaguchi et al. | 345/87 |
| 2004/0246242 | A1 * | 12/2004 | Sasaki | 345/204 |
| 2004/0252111 | A1 * | 12/2004 | Cheon et al. | 345/204 |
| 2005/0093798 | A1 * | 5/2005 | Kamada et al. | 345/89 |

FOREIGN PATENT DOCUMENTS

| | | |
|---|---|---|
| CN | 1576869 A | 2/2005 |
| JP | 2002-366109 | 12/2002 |
| JP | 2003-316330 | 11/2003 |
| JP | 2005-196196 | 7/2005 |

OTHER PUBLICATIONS

Office Action issued in corresponding Chinese Patent Application No. 2007101126863; issued Mar. 28, 2009.
Office Action issued in corresponding Japanese Patent Application No. 2007-196513, mailed Feb. 8, 2011.
Office Action issued in corresponding Japanese Patent Application No. 2007-196513, mailed Feb. 28, 2012.

* cited by examiner

*Primary Examiner* — Sumati Lefkowitz
*Assistant Examiner* — Jonathan Horner
(74) *Attorney, Agent, or Firm* — Brinks Hofer Gilson & Lione

(57) ABSTRACT

The present invention relates to a flat panel display device that is adaptive for preventing a brightness inversion phenomenon generated when the data modulated before are re-modulated in a multi-modulation method where data are modulated several times, and a data multi-modulation method thereof. The flat panel display device includes a first modulator which primarily modulates digital video data, which are to be displayed in a flat panel display panel, with pre-stored first compensation values in order to adjust at least any one of a response characteristic and a contrast ratio of the flat panel display panel. The flat panel display device further includes a second modulator which secondarily modulates the digital video data, which are to be displayed at a defect display area of which the brightness appears different from that of a normal display surface when displaying the same gray level in the flat panel display panel, with pre-stored second compensation values.

7 Claims, 18 Drawing Sheets

FLAT PANEL DISPLAY AND DATA MULTI-MODULATION METHOD THEREOF

This application claims the benefit of the Korean Patent Application No. P2006-0071382, filed on Jul. 28, 2006, which is hereby incorporated by reference.

BACKGROUND OF THE INVENTION

1. Field of the Invention

The present invention relates to a flat panel display device, and more particularly to a flat panel display device that is adaptive for preventing a brightness inversion phenomenon generated when the data modulated before are re-modulated in a multi-modulation method where data are modulated several times, and a data multi-modulation method thereof.

2. Description of the Related Art

Flat panel display devices include a liquid crystal display (LCD), a field emission display (FED), a plasma display panel (PDP), an organic light emitting diode (OLED) and the like, and most of them are put to practical use and sold at a market.

There have been proposed methods of modulating digital video data and driving the flat panel display panel on the basis of the modulated digital video data in order to improve a response speed in the flat panel display device or to improve brightness and contrast in a motion picture.

In order to realize data modulation methods, a drive circuit of the flat panel display device includes circuits for realizing not less than one of the data modulation methods. In case of applying the data modulation methods of various purposes together, if a first data modulation is performed with a certain object value before a second data modulation method where data are modulated with an object value designed by taking the unmodulated original video data as source data, the source data are changed upon the second data modulation, thus the data can be change with a different value from the object value of when being designed. In this case, if the flat panel display panel is driven on the basis of the digital video data modulated by the second data modulation, then brightness inversion might be shown unexpectedly.

SUMMARY OF THE INVENTION

Accordingly, it is an object of the present invention to provide a flat panel display device that is adaptive for preventing a brightness inversion phenomenon generated when the data modulated before are re-modulated in a multi-modulation method where data are modulated several times, and a data multi-modulation method thereof.

In order to achieve these and other objects of the invention, a flat panel display device according to an aspect of the present invention includes: a first modulator which primarily modulates digital video data, which are to be displayed in a flat panel display panel, with pre-stored first compensation values in order to adjust at least any one of a response characteristic and a contrast ratio of the flat panel display panel; and a second modulator which secondarily modulates the digital video data, which are to be displayed at a defect display area of which the brightness appears different from that of a normal display surface when displaying the same gray level in the flat panel display panel, with pre-stored second compensation values.

In the flat panel display device, the defect display area includes: a first defect display area which appears darker than the normal display surface; and a second defect display area which appears brighter than the normal display surface.

In the flat panel display device, the second modulator adds the second compensation value to the digital video data which are to be displayed at the first defect display area; and subtracts the second compensation value from the digital video data which are to be displayed at the second defect display area.

The flat panel display device further includes a memory for storing the compensation values and the location information of the defect display area.

In the flat panel display device, the memory includes any one of EEPROM and EDID ROM.

The flat panel display device further includes: a data drive circuit which converts the digital video data into analog video signals and supplies the analog video signals to data lines of the flat panel display panel; a scan driver circuit for supplying scan signals to the scan lines of the flat panel display panel; and a timing controller for controlling the data drive circuit and the scan drive circuit as well as supplying the digital video data to the data drive circuit.

In the flat panel display device, the timing controller and the first and second modulators are integrated into one chip.

In the flat panel display device, the flat panel display panel includes any one of a liquid crystal display panel, a field emission display, a plasma display panel and an organic light emitting diode.

A flat panel display device according to another aspect of the present invention includes: a first modulator which primarily modulates digital video data, which are to be displayed in a flat panel display panel, with pre-stored first compensation values in order to adjust at least any one of a response characteristic and a contrast ratio of the flat panel display panel; and a second modulator which secondarily modulates the digital video data, which are to be displayed at a link sub-pixel to which two sub-pixels are electrically connected in the flat panel display panel, with pre-stored second compensation values.

In the flat panel display device, the second modulator adds the second compensation value to the digital video data which are to be displayed at the link sub-pixel.

The flat panel display device further includes a memory for storing the compensation values and the location information of the link sub-pixel.

In the flat panel display device, the memory includes any one of EEPROM and EDID ROM.

The flat panel display device further includes: a data drive circuit which converts the digital video data into analog video signals and supplies the analog video signals to data lines of the flat panel display panel; a scan driver circuit for supplying scan signals to the scan lines of the flat panel display panel; and a timing controller for controlling the data drive circuit and the scan drive circuit as well as supplying the digital video data to the data drive circuit.

In the flat panel display device, the timing controller and the first and second modulators are integrated into one chip.

In the flat panel display device, the flat panel display panel includes any one of a liquid crystal display panel, a field emission display, a plasma display panel and an organic light emitting diode.

A flat panel display device according to still another aspect of the present invention includes: a first modulator which primarily modulates digital video data, which are to be displayed in a flat panel display panel, with pre-stored first compensation values in order to adjust at least anyone of a response characteristic and a contrast ratio of the flat panel display panel; and a second modulator which secondarily modulates the digital video data, which are to be displayed at a defect display area of which the brightness appears different from that of a normal display surface when displaying the same gray level in the flat panel display panel, and the digital video data, which are to be displayed at a link sub-pixel to which two sub-pixels are electrically connected in the flat panel display panel, with pre-stored second compensation values.

A data multi-modulation method of a flat panel display device according to still another aspect of the present invention includes: primarily modulating digital video data, which are to be displayed in a flat panel display panel, with pre-stored first compensation values in order to adjust at least any one of a response characteristic and a contrast ratio of the flat panel display panel; and secondarily modulating the digital video data, which are to be displayed at a defect display area of which the brightness appears different from that of a normal display surface when displaying the same gray level in the flat panel display panel, with pre-stored second compensation values.

In the data multi-modulation method, the defect display area includes: a first defect display area which appears darker than the normal display surface; and a second defect display area which appears brighter than the normal display surface.

In the data multi-modulation method, secondarily modulating the digital video data with the pre-stored second compensation values includes: adding the second compensation value to the digital video data which are to be displayed at the first defect display area; and subtracting the second compensation value from the digital video data which are to be displayed at the second defect display area.

A data multi-modulation method of a flat panel display device according to still another aspect of the present invention includes: primarily modulating digital video data, which are to be displayed in a flat panel display panel, with pre-stored first compensation values in order to adjust at least any one of a response characteristic and a contrast ratio of the flat panel display panel; and secondarily modulating the digital video data, which are to be displayed at a link sub-pixel to which two sub-pixels are electrically connected in the flat panel display panel, with pre-stored second compensation values.

In the data multi-modulation method, secondarily modulating the digital video data with pre-stored second compensation values includes: adding the second compensation value to the digital video data which are to be displayed at a first defect display area.

A data multi-modulation method of a flat panel display device according to still another aspect of the present invention includes: primarily modulating digital video data, which are to be displayed in a flat panel display panel, with pre-stored first compensation values in order to adjust at least any one of a response characteristic and a contrast ratio of the flat panel display panel; and secondarily modulating the digital video data, which are to be displayed at a defect display area of which the brightness appears different from that of a normal display surface when displaying the same gray level in the flat panel display panel, and the digital video data, which are to be displayed at a link sub-pixel to which two sub-pixels are electrically connected in the flat panel display panel, with pre-stored second compensation values.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the embodiments, examples of which are illustrated in the accompanying drawings.

With reference to FIGS. 1 to 18, embodiments will be explained as follows.

Figure 1:
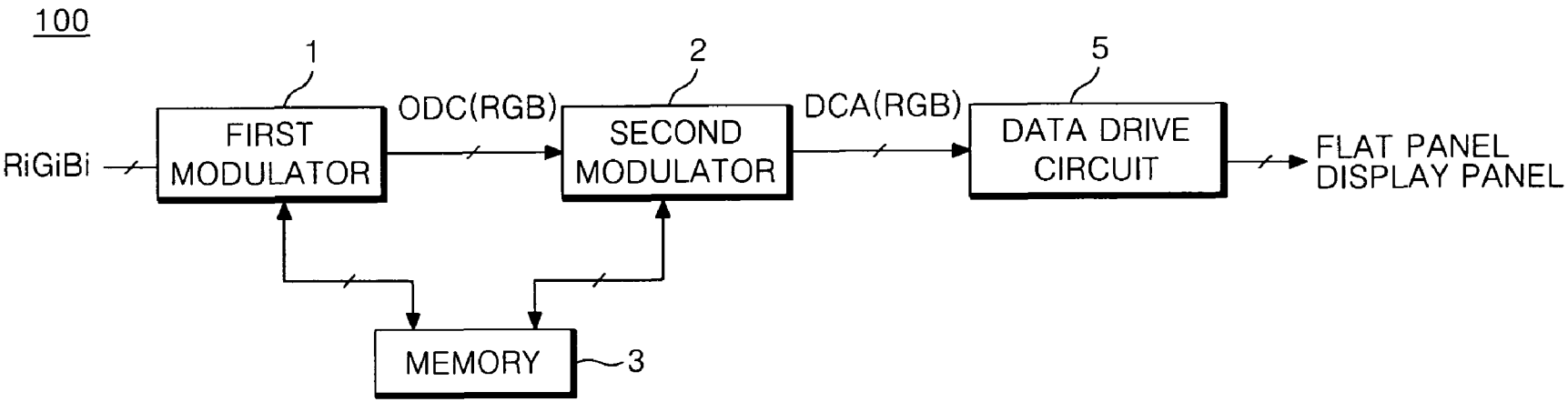
FIG. 1 is a block diagram representing a data multi-modulation device of a flat panel display device according to a first embodiment.

Referring to FIG. 1, a data multi-modulation device 100 of a flat panel display device according to a first embodiment includes a first modulation part 1 which primarily modulates digital video data RiGiBi with a first compensation value for improving a response characteristic; a second modulation part 2 that secondarily modulates the digital video data ODC (RGB), which are to be displayed at a display stain among the digital video data ODC(RGB) modulated by the first modulation part 1, with a second compensation value, that secondarily modulates the digital video data ODC(RGB), which are to be displayed in a display surface corresponding to a lamp bright line, with a third compensation value, and that secondarily modulates the digital video data ODC(RGB), which are to be displayed at a link sub-pixel, with a fourth compensation value for compensating the charge amount of the link sub-pixel; a memory 3 for storing the location information and the compensation values which are required in the first and second modulation parts 1, 2; and a data drive circuit 5 for displaying the digital video data DCA(RGB), which are modulated by the second modulation part 2, in the flat panel display panel.

The memory 3 includes a non volatile memory, e.g., EEPROM (electrically erasable programmable read only memory) and/or EDID ROM (extended display identification data ROM), which can renew or erase the data. The memory 3 stores first to fourth compensation values, which are required for the data modulation of each of the first and second modulation parts 1, 2, and location information which indicates each pixel location of the display stain, the location of the lamp bright line and the location of the link sub-pixel and which is required in the second modulation part 2. On the other hand, at EDID ROM are stored seller/manufacturer identification ID information, the variables and characteristic of a basic display device and the like as basic monitor information data besides the compensation value and the location information. The compensation values are stored at the memory 3 in a type of a lookup table which outputs by taking the digital video data RiGiBi and the location information as a read address.

The first modulation part 1 compares the previous frame data with the current frame data; judges the change of the data in accordance with the comparison result; reads the first compensation value corresponding to the judgment result from the memory 1; and primarily modulates the digital video data RiGiBi with the first compensation value, thereby improving the response characteristic of the flat panel display device. The improvement principle of the response characteristic caused by the first data modulation of the first modulation part 1 will be explained centering on the response characteristic of liquid crystal, as follows.

The liquid crystal display device, as can be known in Mathematical Formulas 1 and 2, has a disadvantage in that the response speed is slow due to the characteristics such as the unique viscosity, elasticity and the like of liquid crystal.

$$T_r \propto (\gamma d^2)/(\Delta\in|V_a^2-V_F^2|) \qquad \text{[Mathematical Formula 1]}$$

Herein, $T_r$ represents a rising time when voltages are applied to a liquid crystal, Va represents an applying voltage, VF is a Freederick transition voltage at which liquid crystal molecules start a tilt movement, d represents a cell gap of a liquid crystal cell, and γ represents a rotational viscosity of the liquid crystal molecule.

$$T_f \propto (\gamma d^2)/K$$

Herein, $T_f$ represents a falling time when the liquid crystal is restored to an original location by an elasticity restoring force, and K represents the unique elastic coefficient of liquid crystal.

Figure 2:
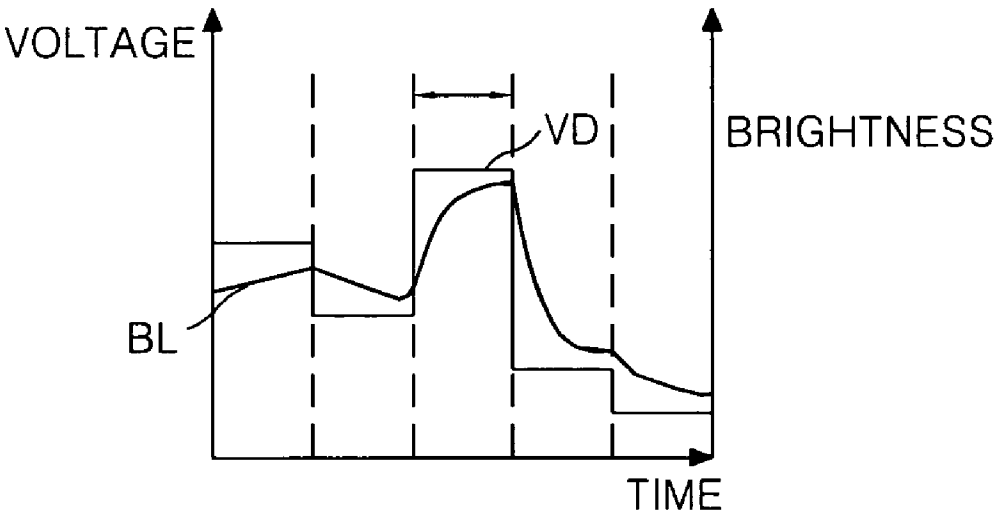
FIGS. 2 and 3 are graphs representing an improvement effect of a response characteristic due to a modulation by a first modulation part shown in FIG. 1.

The response speed of the liquid crystal of a TN (twisted nematic) mode mainly used in the liquid crystal display device can be changed by the physical property of a liquid crystal material, a cell gap and the like, but generally, the rising time is about 20-80 ms and the falling time is about 20-30 ms. The response speed of the liquid crystal is longer than one frame period (NTSC: about 16.67 ms). Because of this, as shown in FIG. 2, it proceeds to the next frame before the voltage with which a liquid crystal cell is charged reaches a desired voltage, thus there might appear a motion burring phenomenon where a screen is blurred in a motion picture. That is to say, when the data VD are changed from one level to another level due to the slow response speed of the liquid crystal, the display brightness BL corresponding thereto does not reach a desired target brightness as in FIG. 2.

Figure 3:
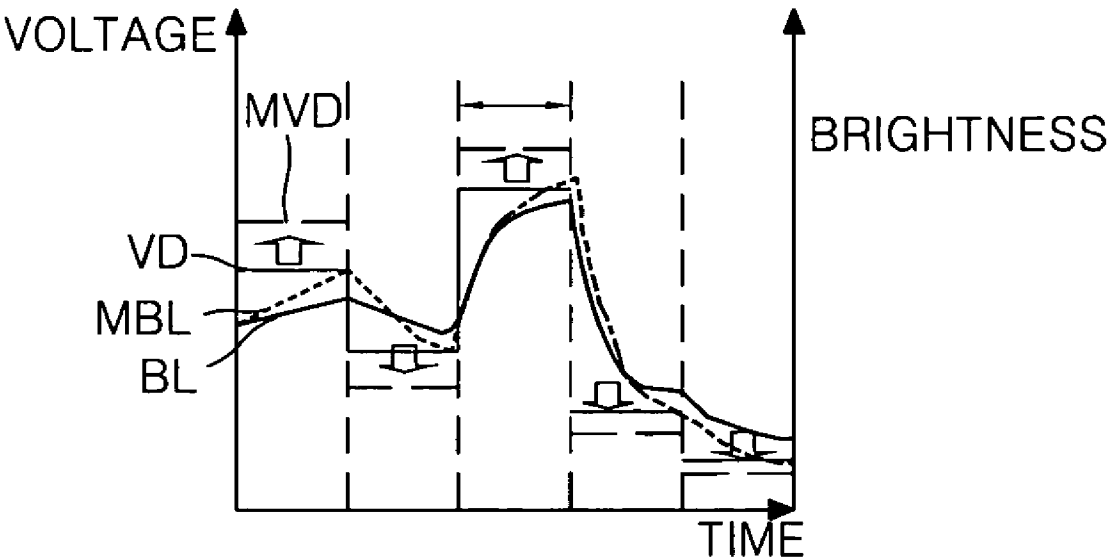
Figure 4:
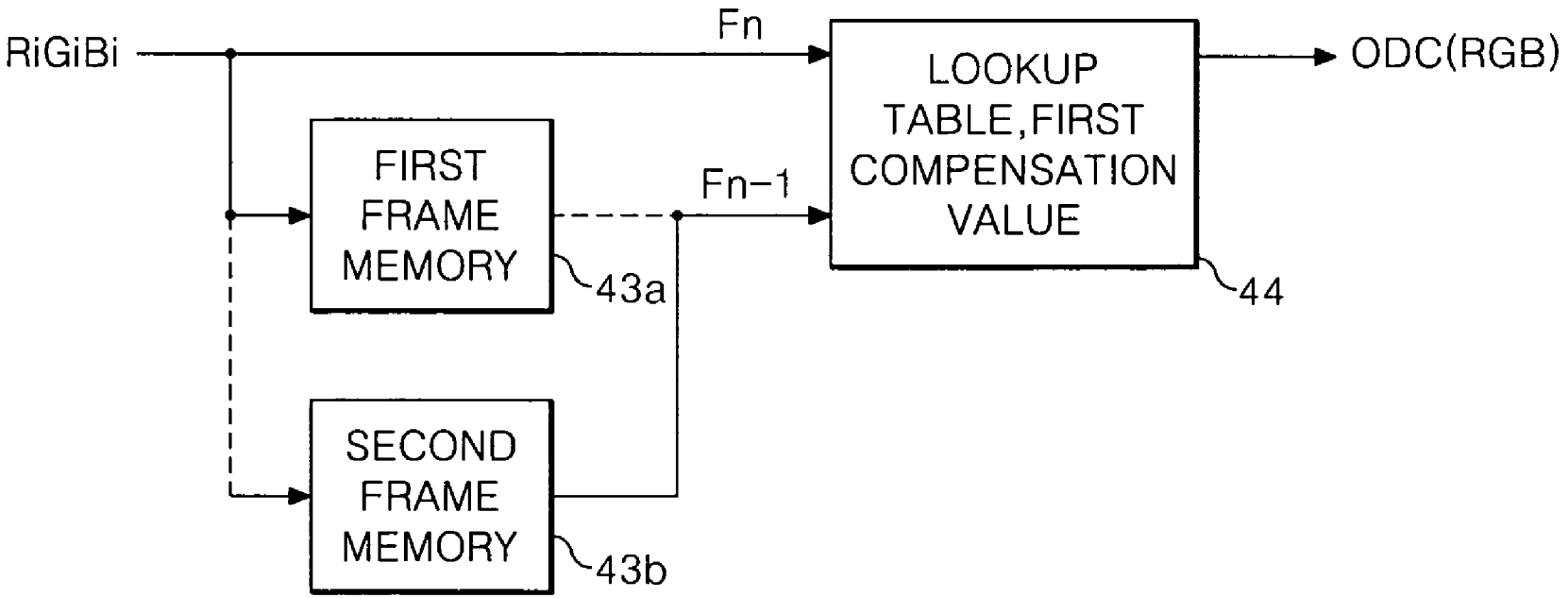
FIG. 4 is a block diagram representing the first modulation part shown in FIG. 1, in detail.

The first modulation part 1 compares the digital video data RiGiBi of the previous frame with that of the current frame, selects a pre-set first compensation value in accordance with the comparison result, and modulates the digital video data RiGiBi with the selected compensation value, thereby making the absolute value of the voltage, i.e., $|V_a^2-V_F^2|$ in Mathematical Formula 1, which is supplied to the liquid crystal display panel, changed high from VD to MVD, as in FIG. 3. To this end, the first modulation part 1 includes two frame memories 43A, 43B and a lookup table 44, as shown in FIG. 4.

The first and second frame memories 43A, 43B alternately store the data by the unit of a frame, and alternately output the stored data, thereby supplying the previous frame data, i.e., $(n-1)^{th}$ frame data Fn−1 to a lookup table 44.

The lookup table 44 has the first compensation values registered therein as in TABLE 1 below, and is stored at the memory 3. The lookup table 44 compares the $n^{th}$ frame data Fn with the $(n-1)^{th}$ frame data Fn−1 inputted from the first and second frame memories 43A, 43B, and outputs the first compensation value corresponding to the comparison result as the primarily-modulated digital video data ODC(RGB). The lookup table 44 is stored at the memory 3 and loaded in the first modulation part 1 right after voltages are supplied to the flat panel display device.

TABLE 1

| Classification | 0 | 32 | 64 | 96 | 128 | 160 | 192 | 208 | 224 | 240 | 248 | 255 |
|---|---|---|---|---|---|---|---|---|---|---|---|---|
| 0 | 0 | 36 | 76 | 113 | 152 | 184 | 214 | 225 | 238 | 249 | 253 | 255 |
| 32 | 0 | 32 | 72 | 110 | 149 | 182 | 212 | 224 | 237 | 247 | 253 | 255 |
| 64 | 0 | 28 | 64 | 104 | 143 | 177 | 209 | 222 | 235 | 246 | 252 | 255 |
| 96 | 0 | 27 | 60 | 96 | 136 | 172 | 205 | 220 | 233 | 245 | 252 | 255 |
| 128 | 0 | 27 | 56 | 89 | 128 | 166 | 201 | 216 | 231 | 243 | 251 | 255 |
| 160 | 0 | 27 | 53 | 83 | 121 | 160 | 197 | 213 | 229 | 242 | 251 | 255 |
| 192 | 0 | 27 | 51 | 77 | 114 | 153 | 192 | 210 | 227 | 241 | 250 | 255 |
| 208 | 0 | 27 | 50 | 73 | 111 | 149 | 189 | 208 | 225 | 241 | 250 | 255 |
| 224 | 0 | 27 | 48 | 70 | 106 | 145 | 186 | 205 | 224 | 240 | 249 | 255 |
| 240 | 0 | 27 | 46 | 69 | 104 | 143 | 185 | 204 | 223 | 240 | 249 | 255 |
| 248 | 0 | 27 | 45 | 68 | 103 | 142 | 184 | 203 | 223 | 239 | 248 | 255 |
| 255 | 0 | 27 | 44 | 67 | 102 | 141 | 183 | 203 | 222 | 239 | 247 | 255 |

In TABLE 1, a leftmost column represents the digital video data RiGiBi of the previous frame Fn−1, and an uppermost row represents the digital video data RiGiBi of the current frame Fn.

As can be known in TABLE 1, the first modulation part 1 modulates the digital video data RiGiBi according to Mathematical Formulas 3 to 5 below.

$$Fn(RiGiBi)<Fn-1(RiGiBi)\rightarrow Fn(ODC(RGB))<FN(RiGiBi) \quad \text{[Mathematical Formula 3]}$$

$$Fn(RiGiBi)=Fn-1(RiGiBi)\rightarrow Fn(ODC(RGB))=FN(RiGiBi) \quad \text{[Mathematical Formula 4]}$$

$$Fn(RiGiBi)>Fn-1(RiGiBi)\rightarrow Fn(ODC(RGB))>FN(RiGiBi) \quad \text{[Mathematical Formula 5]}$$

As can be known in Mathematical Formulas 3 to 5, the first modulation part 1 modulates the digital video data RiGiBi with a value which is larger than that of the current frame Fn if the pixel data value becomes greater at the same pixel in the current frame Fn than in the previous frame Fn−1 according to the pre-determined first compensation value. But, on the other hand, the first modulation part 1 modulates the digital video data RiGiBi with a value which is smaller than that of the current frame Fn if the pixel data value becomes smaller in the current frame Fn than in the previous frame Fn−1. And, if the pixel data value is identical at the same pixel in the current frame Fn and in the previous frame Fn−1, the first modulation part 1 modulates the digital video data RiGiBi with the same value of the current frame Fn, i.e., the data of the current frame Fn are supplied to the second modulation part 2 as it is.

The first modulation part 1 might make the response characteristic of the liquid crystal faster in use of the modulation method disclosed in U.S. Pat. Nos. 7,034,786, 7,136,037, 6,753,837, 7,023,414, 6,788,280, 7,161,575, 6,771,242, 7,145,534, 6,760,059, 7,106,287, 7,123,226 and the like proposed by this applicant.

The second modulation part 2 secondarily modulates the digital video data ODC(RGB), which are to be displayed in a block, belt, dot or indeterminate form display stain which is shown due to a brightness difference in the display surface of a flat panel display panel, on the basis of the brightness measured in an inspection process of the flat panel display panel. The display stain is mainly generated by the overlapping of lenses, a lens aberration and the like in an exposure process of a photolithography process. Specifically, due to the difference of the exposure amount of a photo-resist, there exist a parasitic capacitance deviation between the gate and drain (or source) electrodes of a thin film transistor TFT, a height deviation in column spacers for keeping a cell gap, a parasitic capacitance deviation between a signal line and a pixel electrode, and the like in a display surface of a flat panel display panel. As a result thereof, there appears a display stain of which the brightness is high or low in the block, belt, dot or indeterminate form when compared with a normal display surface of which the brightness is normal. The display stain includes a surface of which the brightness appears different from that of the normal display surface, or a boundary part which makes a boundary with the normal display surface and of which the brightness is changed in a gradual inclination. The brightness of the display stain is generally higher or lower than that of the normal display surface, thus the second modulation part 2 adds a second compensation value to or subtracts the second compensation value from the digital video data ODC(RGB), which are to be displayed at the display stain, thereby compensating the brightness of the display stain to be similar to the brightness of the normal display surface.

Figure 5:
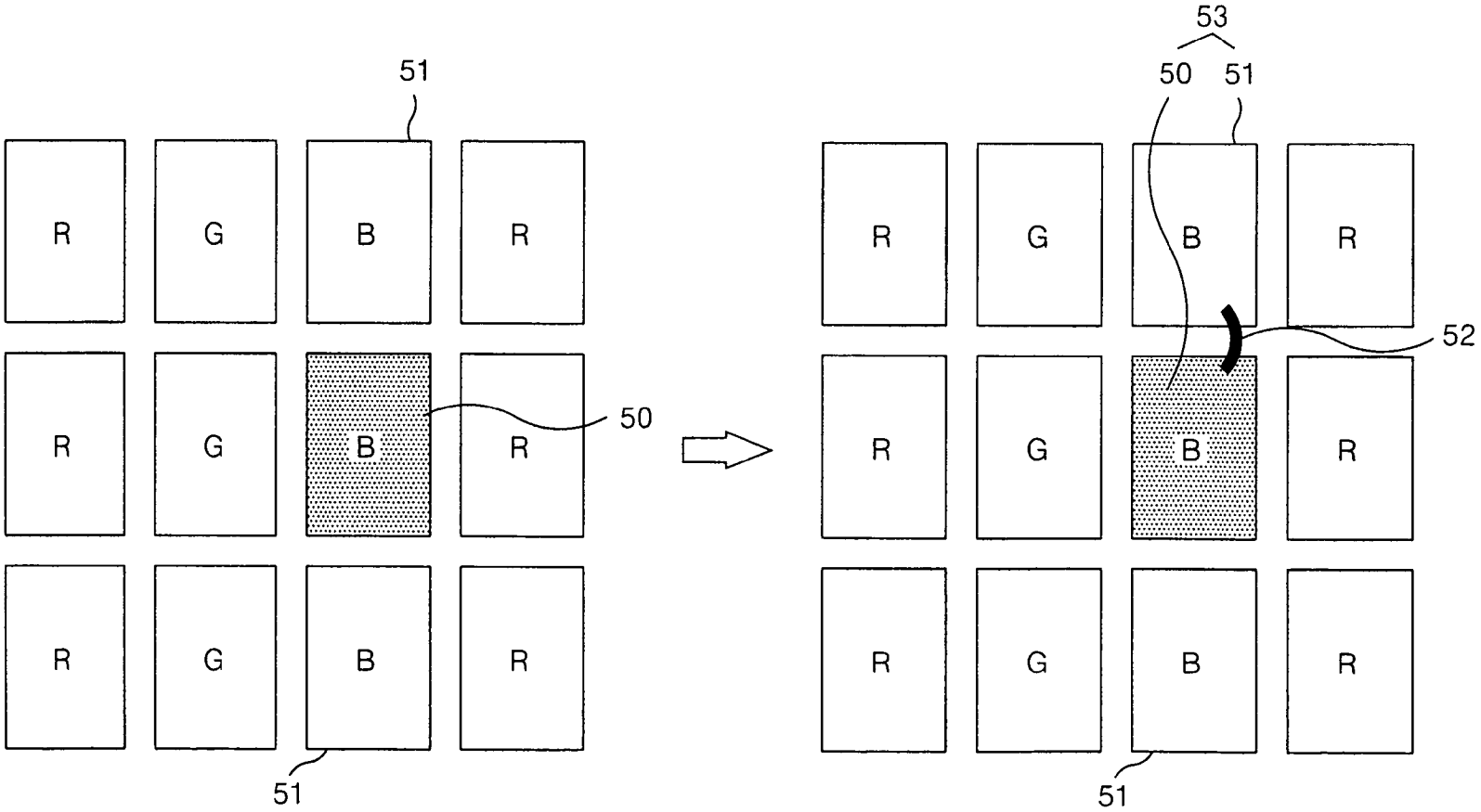
FIG. 5 is a diagram explaining a link sub-pixel.

Further, the second modulation part 2 reads a third compensation value for compensation a lamp bright line, which shows a lamp of a direct type backlight unit in the liquid crystal display device that adopts the direct type backlight unit other than the display stain of the flat panel display panel, from the memory 3; and subtracts the third compensation value from the digital video data ODC(RGB) corresponding to the lamp bright line, thereby compensating the brightness of a part which appears bright because of the lamp bright line. Further, the second modulation part 2, as shown in FIG. 5, electrically shorts a defect sub-pixel 50, to which signals are not supplied due to a TFT defect and the like, from an adjacent sub-pixel 51 which expresses the same color as the defect sub-pixel 50; and modulates the digital video data ODC (RGB), which are to be displayed at the link sub-pixel 53, with a fourth compensation value for compensating a charge characteristic for the link sub-pixel 53. To describe this in detail, the normal sub-pixel 51 and the defect sub-pixel 50 of the same color are electrically connected through a conductive short pattern 52 in a repair process, as in FIG. 5. In the link sub-pixel 53, the normal sub-pixel 53 and the defect sub-pixel 50 are charged with data voltages at the same time. But, the link sub-pixel 53 has a different charge characteristic from the unlinked normal sub-pixel 51 because charges are supplied to the pixel electrodes included in two sub-pixels through one thin film transistor. For example, in case that the same data voltages are supplied to the link sub-pixel 53 and the unlinked normal sub-pixel 51, the link sub-pixel 53 is less in the charge amount than the unlinked normal sub-pixel 51 because the charges dispersed to two sub-pixels. As a result, when the same data voltages are supplied to the unlinked normal pixel 51 and the link sub-pixel 53, the link sub-pixel 53 appears brighter than the unlinked normal sub-pixel 51 in a normally white mode where the transmittance or gray level is increased as the data voltage is lower. On the contrary, when the same data voltages are supplied to the unlinked normal pixel 51 and the link sub-pixel 53, the link sub-pixel 53 appears darker than the unlinked normal sub-pixel 51 in a normally black mode where the transmittance or gray level is increased as the data voltage is higher. In order to compensate the charge amount deterioration of the link sub-pixel 53, the fourth compensation value is added to or subtracted from the digital video data ODC(RGB) which are to be displayed at the link sub-pixel 53. The fourth compensation value is changed in accordance with the gray level value of the digital video data ODC(RGB), which are to be displayed at the link sub-pixel 53, and the location of the link sub-pixel 53.

A determining method of the compensation values used in the second modulation part 2 and an example of a brightness difference compensation of the display surface using the compensation value thereof will be explained in conjunction with FIGS. 6 to 11.

Figure 6:
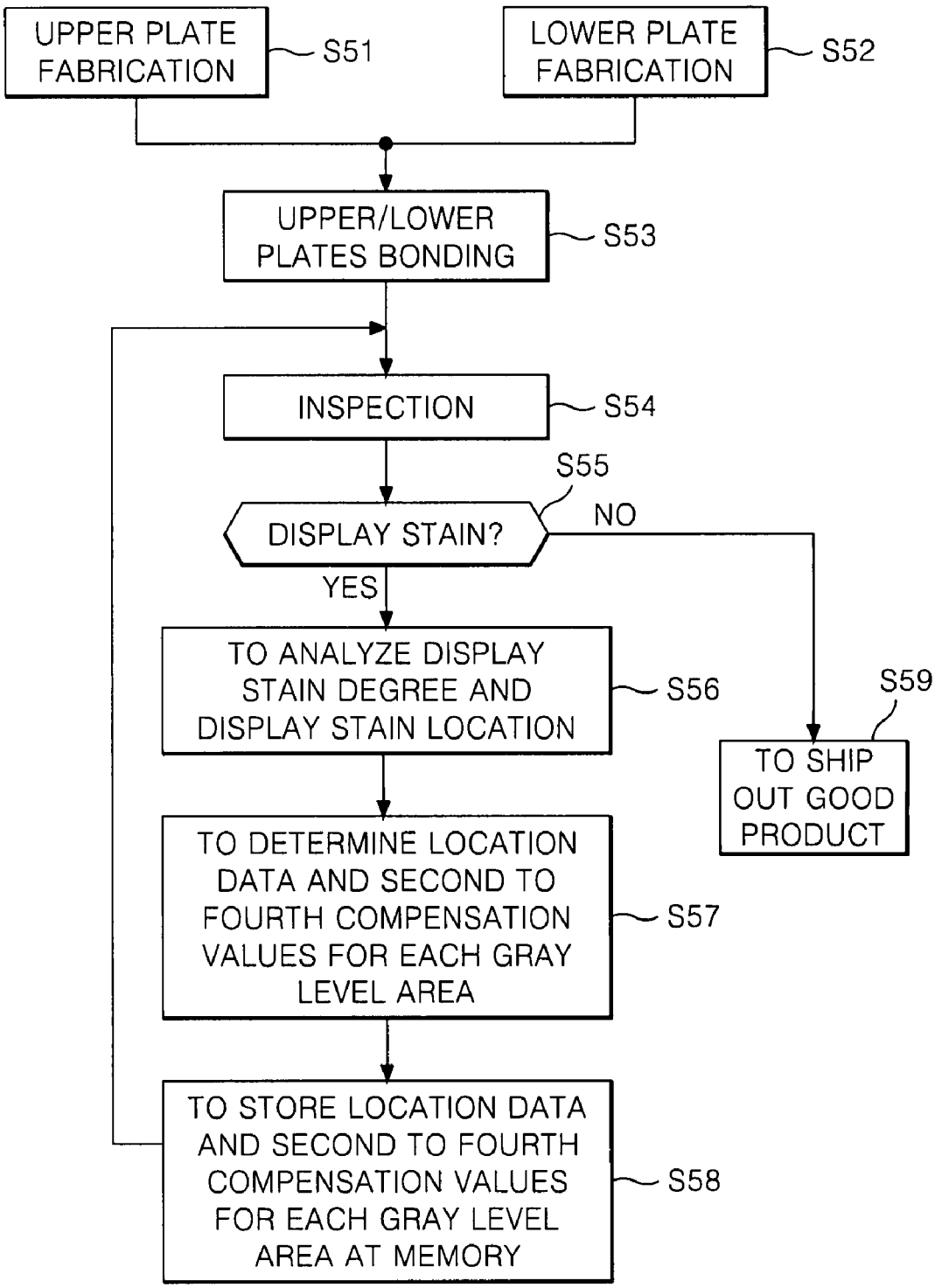
FIG. 6 is a flow chart representing a process sequence from an inspection process for a flat panel display panel to a determining and saving process of second to fourth compensation values, step by step.
Figure 7:
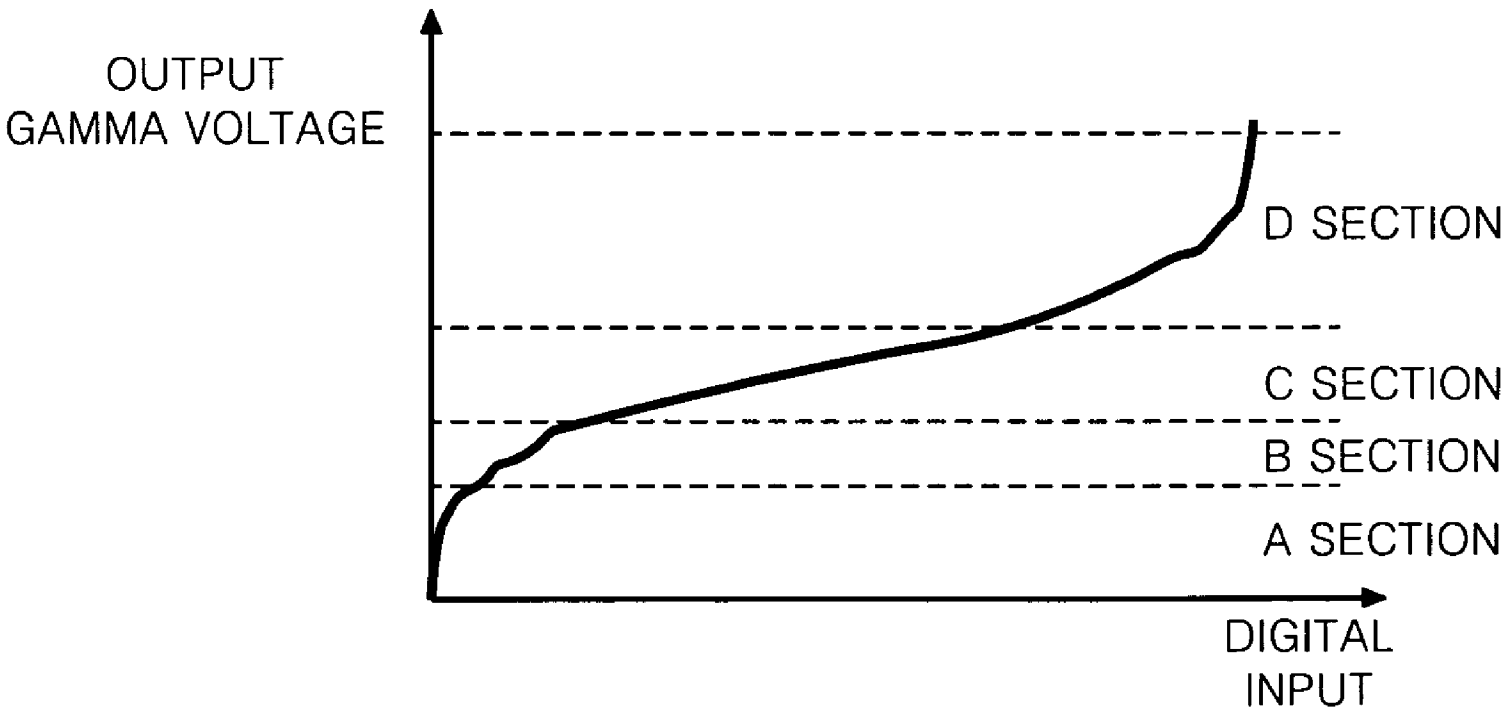
FIG. 7 is a graph representing a gamma compensation value for each gray level.
Figure 8:
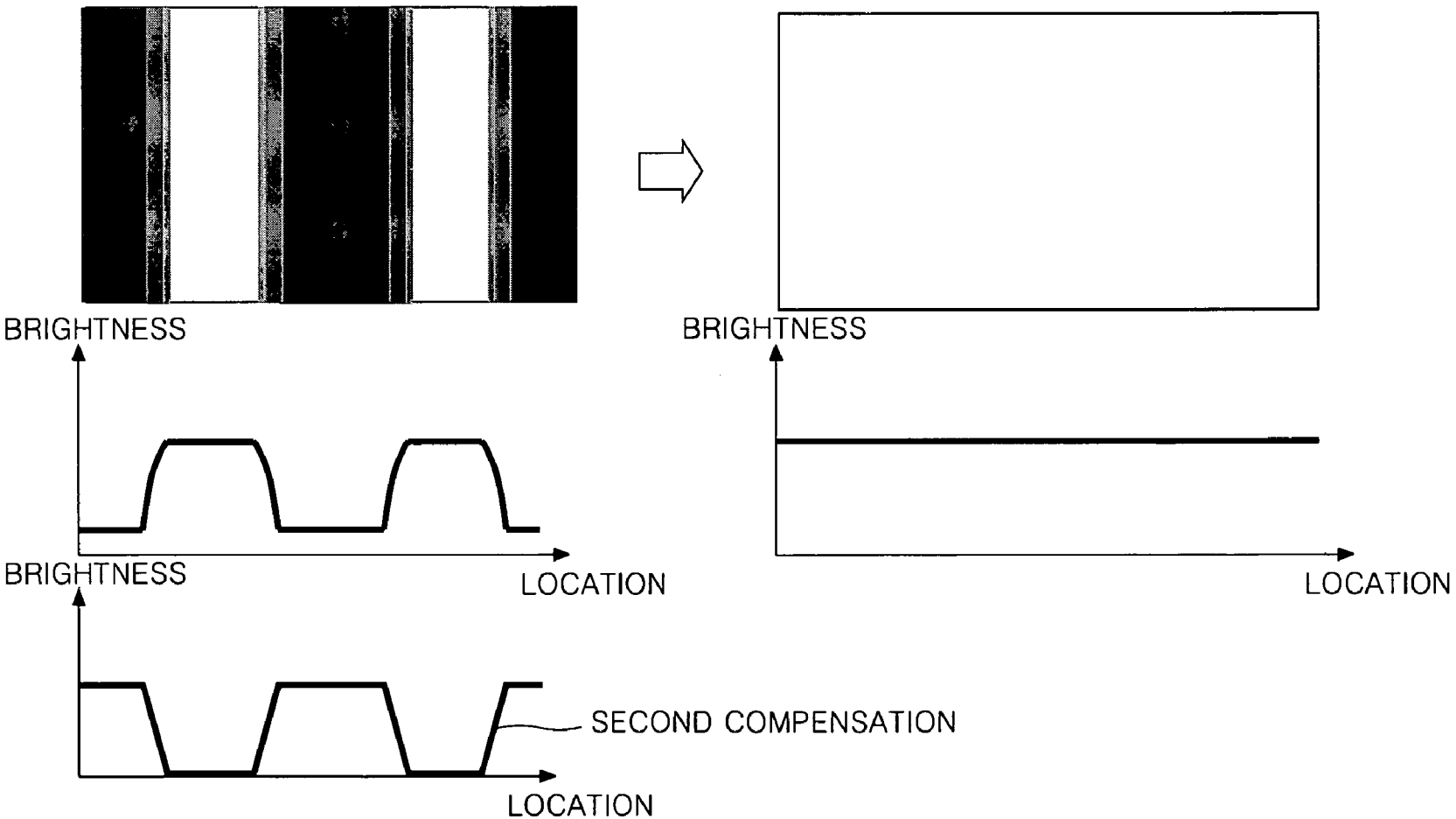
FIG. 8 is a diagram representing a brightness difference between a display stain and a normal display surface, a second compensation value and a brightness compensation example of the display stain to which the second compensation value is applied.

Referring to FIG. 6, a fabricating method of a flat panel display device according to an embodiment bonds an upper plate and a lower plate with a sealant or frit glass after fabricating the upper plate and the lower plate separately (S51, S52, S53). The upper and lower plates can be fabricated in various shapes in accordance with the kind of the flat panel display panel. For example, in case of the liquid crystal display panel, in the upper plate might be formed color filters, a black matrix, a common electrode, an upper alignment film and the like; and in the lower plate might be formed data lines, gate lines, TFTs, pixel electrodes, a lower alignment film, column spacers and the like. In case of a plasma display panel, in the lower plate might be formed address electrodes, a lower dielectric substance, barrier ribs, a phosphorus and the like; and in the upper plate might be formed an upper dielectric substance, an MgO passivation film and a pair of sustain electrodes.

Subsequently, in the inspection process of the flat panel display device where the upper/lower plates are bonded together, a test picture is displayed by applying the test data of each gray level to the flat panel display device, and the brightness of the whole display surface is measured by an electrical inspection and/or visual inspection in use of measurement equipment such as camera and the like for the picture (S54). And, if the display stain is detected in the flat panel display device in the inspection process (S55), then the location where the display stain appears and the brightness of the display stain are analyzed (S56). Herein, the display stain includes a surface of which the brightness is lower or higher than the normal display surface, or a lamp bright line of which the brightness is higher than the normal display surface, as described above.

And, after the compensation value for each gray level area and the location data indicating each pixel of the display stain in a display stain judging process of the flat panel display device, the present invention stores the location data, which indicates the location for each pixel of the display stain, and the compensation values, which are added to or subtracted from the digital video data ODC(RGB), at the memory 3 through a user connector and a ROM writer (S57,S58). Herein, the compensation value added to or subtracted from the digital video data ODC(RGB) should be optimized for each gray level area (section A to section D) in consideration of an analog gamma characteristic of the panel display panel, as in FIG. 7. For example, the second and third compensation values are different for each location of which the brightness is different in the display stain, and are changed in accordance with the gray level, even at the same location. In other words, the compensation value for each gray level area of the display stain is changed in accordance with the location of the display stain, the brightness difference between the display stain and the normal display surface, the gray level value of the digital video data to be displayed at the display stain, and the like.

If the size, number and extent of the display stain are detected to be not higher than a good product reference tolerance, the flat panel display device is judged as a good product to be shipped out (S59).

On the basis of the location data and the compensation value determined through such a series of processes, the second modulation part 2 modulates the digital video data ODC(RGB), which are to be displayed at the display stain of the dot, surface, line, dot or indeterminate form. The compensation value is added to the digital video data which are to be displayed at the display stain of which the brightness is lower at the same gray level than the normal display surface. But, on the contrary, the compensation value is subtracted from the digital video data which are to be displayed at the lamp bright line or the display stain of which the brightness is higher at the same gray level than the normal display surface. In this way, the digital video data DCA(RGB) which are modulated by the second modulation part 2 to be supplied to a data drive circuit 5 are converted into analog voltages or analog currents by the drive circuit 5 in accordance with a drive characteristic of the flat panel display panel, and then are supplied to the flat panel display panel. As the modulation result of the digital video data by the first and second modulation parts 1, 2, the data displayed in the flat panel display panel are faster in response speed than when not being modulated, and the brightness of the display stain part is almost not different from the brightness of the normal display surface.

The compensation value required for the modulation of the second modulation part 2 can be determined to be an integer or an integer+a decimal fraction of less than 1, and the second modulation part 2 expresses the decimal fraction of the compensation value by the dithering according to a pre-set program or the frame rate control (hereinafter, referred to as "FRC") using a dither pattern, as in FIG. 9.

Figure 9:
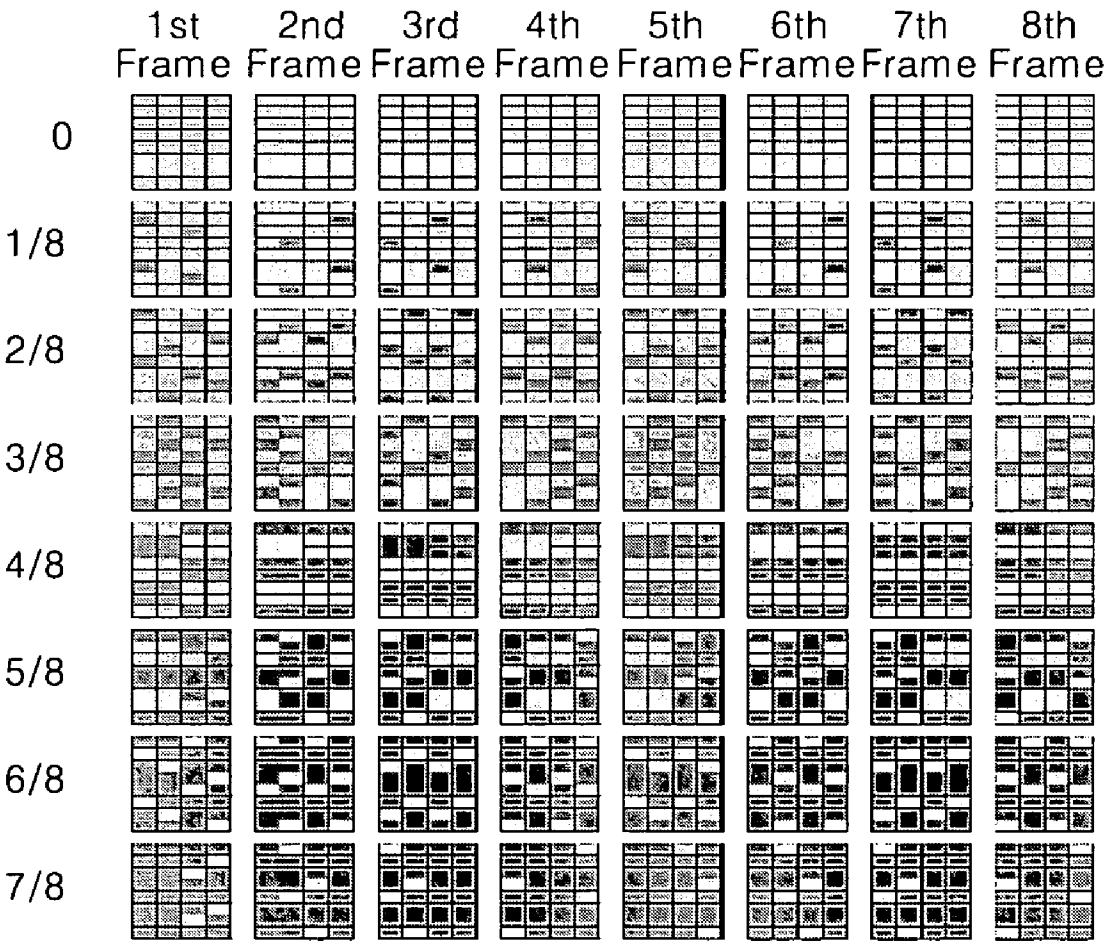
FIG. 9 is a graph representing an example of dither patterns which can be applied to a frame rate control FRC.

FIG. 9 shows a ⅛ dither pattern for expressing a compensation value of '⅛', a ⅜ dither pattern for expressing a compensation value of '⅜', a ⅜ dither pattern for expressing a compensation value of '⅜', a ⅜ dither pattern for expressing a compensation value of '⅜', a ⅝ dither pattern for expressing a compensation value of '⅝', a ⅝ dither pattern for expressing a compensation value of '⅝', and a ⅞ dither pattern for expressing a compensation value of '⅞'. The part marked in red in each dither pattern represents a compensation pixel where '1' is added to the digital video data ODC (RGB); the compensation value is determined in accordance with the number of compensation pixels within each dither pattern of a 4(pixel)×8(pixel) size; and the locations of the compensation pixels are changed for each frame period in order to reduce a repetition cycle of the pixel to which the compensation value is applied.

To the second modulation part can be applied the modulation method disclosed in U.S. patent application Ser. Nos. 11/477,386, 11/477,228, 11/478,993, 11/479,172, 11/475,104, 11/476,854, 11/477,567 and the like which are proposed by this applicant.

Figure 10:
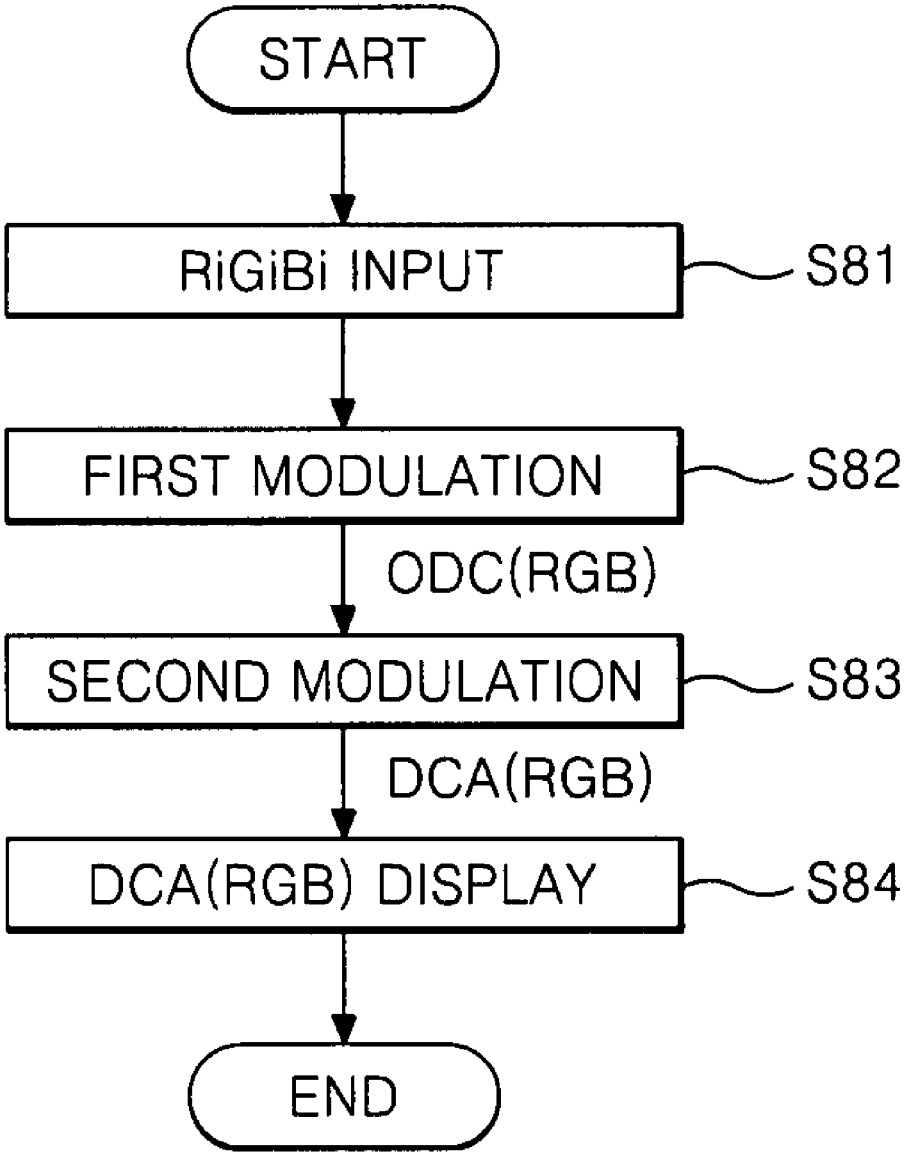
FIG. 10 is a flow chart representing a control sequence of a data multi-modulation method of a flat panel display device according to a first embodiment, step by step.
Figure 11:
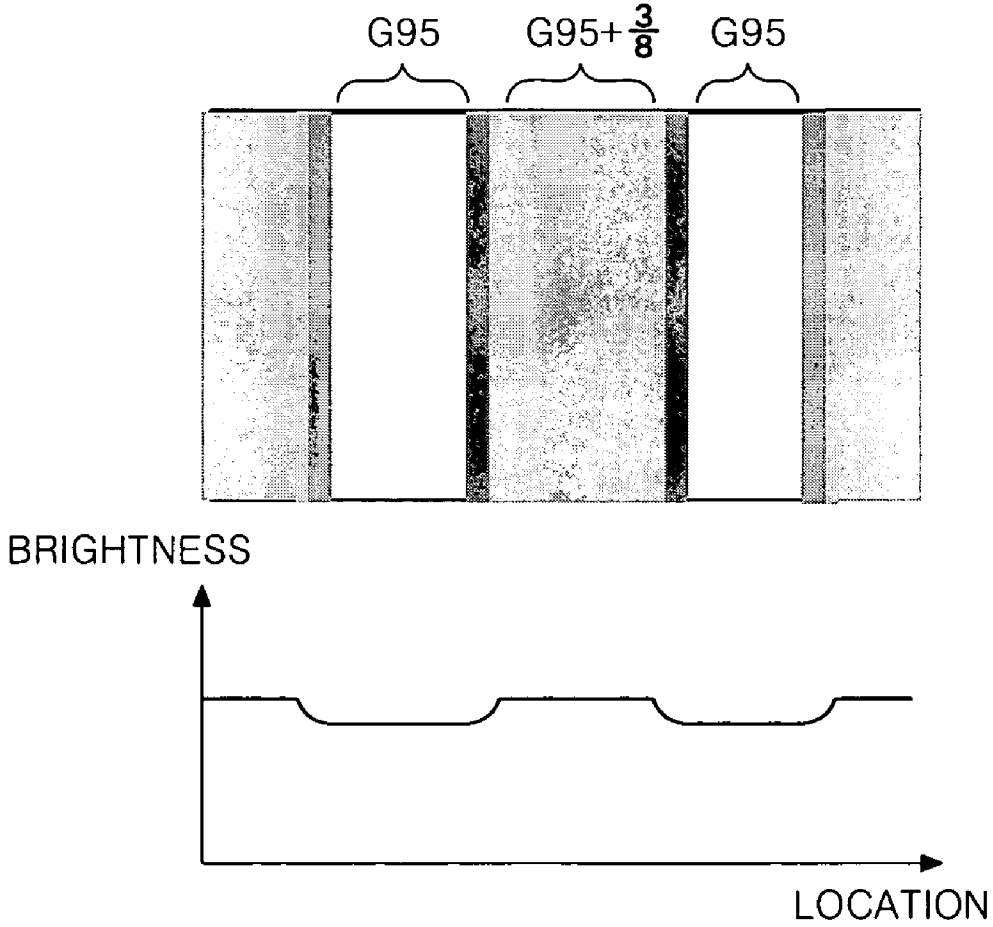
FIG. 11 is a diagram explaining an example of a brightness inversion phenomenon which might appear when the modulation sequence is changed.

FIG. 10 is a flow chart representing a control sequence of a data multi-modulation method of a flat panel display device according to a first embodiment, step by step.

Referring to FIG. 10, the data multi-modulation method of the present invention compares the digital video data RiGiBi of the previous frame Fn−1 with the digital video data RiGiBi of the current frame Fn; primarily modulates the digital video data RiGiBi of the current frame with the compensation value, which is pre-set for improving the response characteristic, in accordance with the comparison result; and generates the primarily-modulated digital video data ODC(RGB) (S81, S82). And, the data multi-modulation method of the present invention secondarily modulates the digital video data ODC (RGB), which are to be displayed at a defected location among the primarily-modulated digital video data ODC (RGB), with the compensation value which are pre-set for compensating the brightness of the display stain; and generates the secondarily-modulated digital video data DCA (RGB) (S83).

Lastly, the data multi-modulation method of the present invention converts the secondarily-modulated digital video data DCA(RGB) into the analog voltages or analog currents in accordance with the drive characteristic of the flat panel display panel, and then displays a picture by supplying the analog voltages or currents to the flat panel display panel (S84).

In the foregoing first embodiment of the data multi-modulation method of the flat panel display device, if the locations of the first modulation part 1 and the second modulation part 2 are interchanged, there might appear a brightness inversion phenomenon. An example like this is as follows. The example will be explained in conjunction with TABLEs 1 to 3 and FIG. 11.

It is assumed that the first modulation is performed on the digital video data with '⅜' being the compensation value which is optimized for compensating the brightness of the display stain to be the same brightness of the normal display surface in a gray level area where the gray level value of the digital video data is 50-100, and then the digital video data primarily modulated with the compensation values as in TABLE 1 are secondarily modulated in order to improve the response characteristic of the flat panel display panel.

If the input digital video data RiGiBi of a gray level value G95 (R data 95, G data 95, B data 95), which are to be displayed at the display stain, have a 4(pixel)×8(pixel) size and the compensation value '⅜' is added thereto for 8 frame periods by the ⅜ dither pattern where '1' is added to 12 compensation pixels, then the gray level value of 20 digital video data RiGiBi among 32 inputted in the $(n-1)^{th}$ frame Fn−1 within the dither pattern is 'G95' and the gray level value of the 12 digital video data RiGiBi corresponding to the compensation pixels within the dither pattern is changed from 'G95' to 'G96'.

For the display stain compensated with the first compensation value by the ⅜ dither pattern, if the digital video data RiGiBi inputted in the $(n-1)^{th}$ frame Fn−1 are changed in the $n^{th}$ frame Fn, as in TABLE 2 below, and are secondarily modulated with the first compensation value for the response characteristic improvement, as in TABLE 1, in accordance with the presence or absence of a change and the extent of the change, then the compensation degree thereof is as in TABLE 2.

TABLE 2

| RiGiBi (Fn − 1) | DCA(RGB) compensated with 3/8 dither pattern | DCA(RGB) (Fn − 1 => Fn) | First compensation value to be applied to DCA(RGB) (Fn) |
|---|---|---|---|
| G95 (12) | G95 (12) | G95 => G96 (12) | +0.25 |
| G95 (8) | G95 (8) | G95 => G95 (8) | 0 |
| G95 (12) | G96 (12) | G96 => G95 (12) | −0.125 |

In TABLE 2, the first compensation value for improving the response characteristic is obtained by TABLE 1 and Mathematical Formulas 3 to 5. That is to say, if the gray level value of the digital video data is 'G96' in the $(n-1)^{th}$ frame period Fn−1, as in TABLE 1, and is lowered to 'G64' in the $n^{th}$ frame period Fn after then, the gray level value is decreased by −4 in the $n^{th}$ frame period Fn due to the first compensation value for improving the response characteristic. That is to say, if G96(Fn−1)=>G64(Fn), then the digital video data become 'G60(Fn)'. On the contrary, if the gray level value of the digital video data is 'G64' in the $(n-1)^{th}$ frame period Fn−1, as in TABLE 1, and is increased to 'G96' in the $n^{th}$ frame period Fn after then, the gray level value is increased by +8 in the $n^{th}$ frame period Fn due to the first compensation value for improving the response characteristic. That is to say, if G64 (Fn−1)=>G96(Fn), then the digital video data become 'G104 (Fn)'. If such a relation and a linear approximation are used, the first compensation value of when the gray level value of the digital video data is increased or decreased by 1 gray level in a range between G96(Fn−1)~G64 (Fn), G64(Fn−1)~G96 (Fn) is obtained in a proportional expression below.

1:x=32:8, thus the first compensation value x of when the digital video data is increased by 1 gray level between the $(n-1)^{th}$ frame and the nth frame within the above-mentioned gray level range becomes +0.25, i.e., x=+0.25.

And, 1:x=32:4, thus the first compensation value x of when the digital video data is decreased by 1 gray level between the $(n-1)^{th}$ frame and the $n^{th}$ frame within the above-mentioned gray level range becomes −0.125, i.e., x=−0.125. If the first compensation value is added to n digital video data of TABLE 2 which are primarily modulated with the ⅜ dither pattern, the result thereof is as in TABLE 3 below.

TABLE 3

| DCA(RGB) (Fn − 1 => Fn) | Secondarily modulated with second compensation value which is to be applied to DCA(RGB) (Fn) |
|---|---|
| G95 => G96 (12) | (96 + 0.25) × 12 = 1155 |
| G95 => G95 (8) | 95 × 8 = 760 |
| G96 => G95 (12) | (95 − 0.125) × 12 = 1138.5 |

Accordingly, the digital video data of 32 pixels compensated with the ⅜ dither pattern within the display stain are secondarily modulated with the first compensation value in order to improve the response characteristic, and then the average gray level value of the digital video data to be displayed at the 32 pixels is changed to '95.421875'.

In comparison with this, an ideal average gray level value of the digital video data to be displayed at the 32 pixels within the display stain is '95+⅜=95.375'. Accordingly, if the modulation is performed in the order of the second modulation part 2->the first modulation part 1, the ideal compensation result is added more by 0.046875 in the 32 pixels within the display stain, thus there appears the brightness inversion phenomenon where the brightness of the display stain appears higher, as in FIG. 11. In other words, in case that the gray level value 'G95' is displayed in the whole display surface of the same flat panel display panel, when the digital video data is +0.375 in the display stain, the brightness of the display stain is almost the same as the brightness of the reference surface, as in FIG. 8, but if the modulation sequence is changed, the brightness of the display stain is over-compensated, thus the brightness of the display stain is increased, as in FIG. 11.

Figure 12:
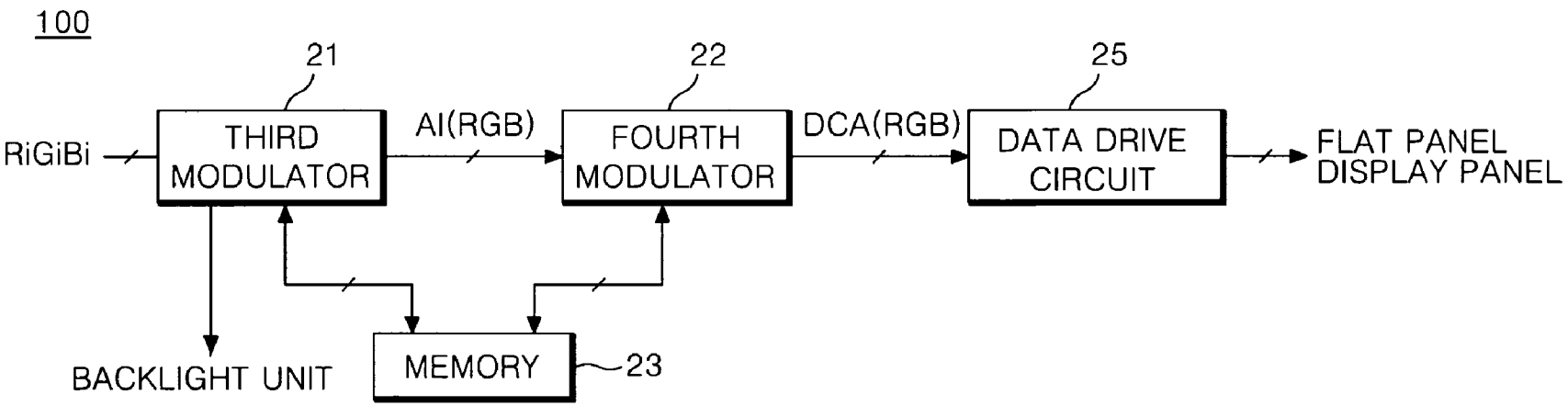
FIG. 12 is a block diagram representing a data multi-modulation device of a flat panel display device according to a second embodiment.

FIG. 12 represents a data multi-modulation device 100 of a flat panel display device according to a second embodiment.

Referring to FIG. 12, the data multi-modulation device 100 of the flat panel display device according to the second embodiment includes a third modulation part 21 which analyzes the brightness of the digital video data RiGiBi of one screen, primarily modulates digital video data RiGiBi on the basis of the brightness analysis result, and adjusts the brightness of a backlight at the same time; a fourth modulation part 22 that secondarily modulates the digital video data AI(RGB), which are to be displayed at a display stain among the digital video data AI(RGB) modulated by the third modulation part 21, with a second compensation value for compensating the brightness of the display stain, that secondarily modulates the digital video data AI(RGB), which are to be displayed in a display surface corresponding to a lamp bright line, with a third compensation value, and that secondarily modulates the digital video data AI(RGB), which are to be displayed at a link sub-pixel, with a fourth compensation value for compensating the charge amount of the link sub-pixel; a memory 23 for storing the location information and the compensation values which are required in the third and fourth modulation parts 21, 22; and a data drive circuit 25 for displaying the digital video data DCA(RGB), which are inputted from the fourth modulation part 22, in the flat panel display panel.

The memory 23 includes EEPROM and/or EDID ROM similarly to the foregoing embodiment. The memory 23 stores compensation values, which are required for the data modulation of each of the third and fourth modulation parts 3, 4, and location information which is required in the fourth modulation part 22.

Figure 13:
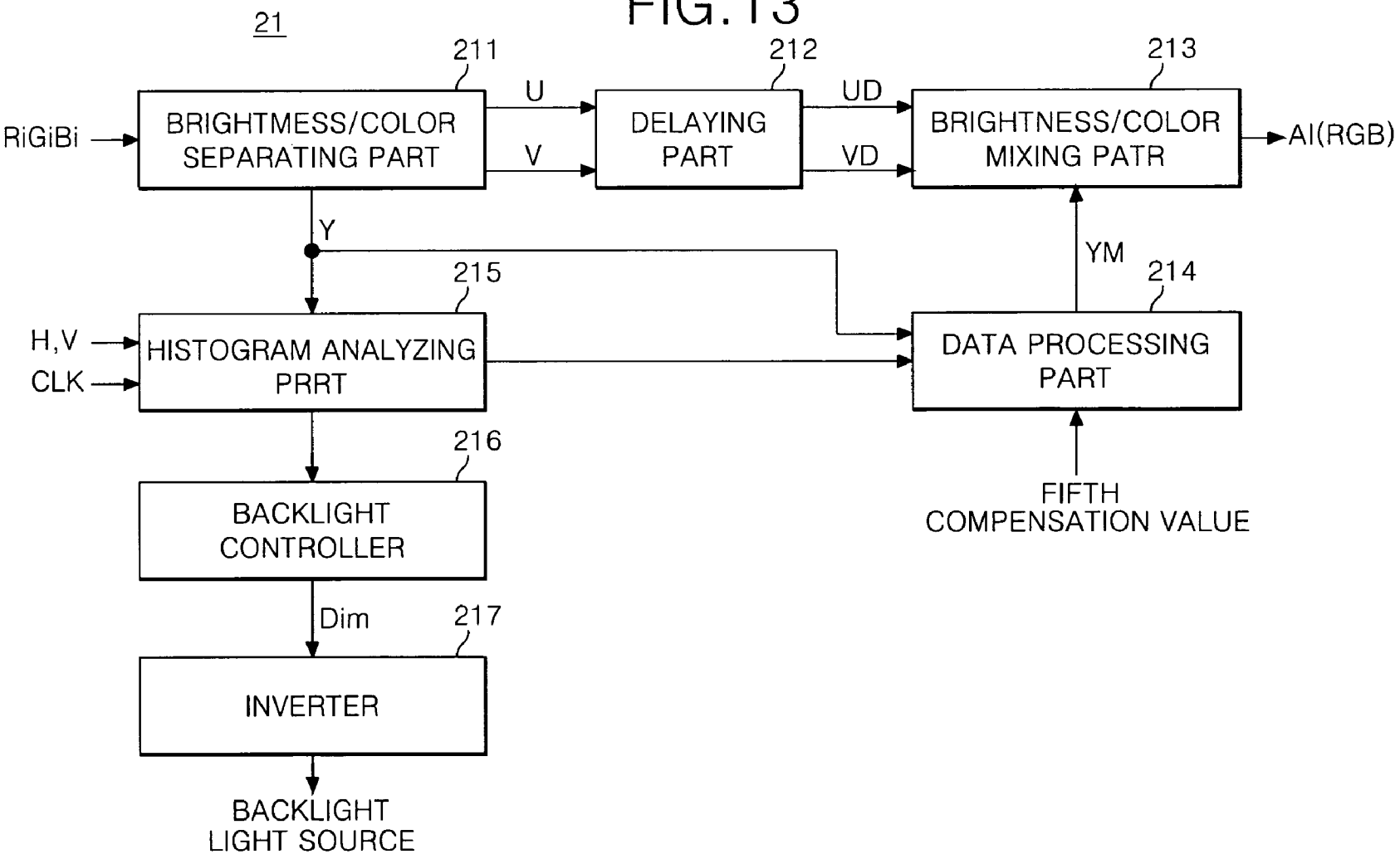
FIG. 13 is a block diagram representing a third modulation part shown in FIG. 12, in detail.

The third modulation part 21 analyzes the brightness of the digital video data RiGiBi of one screen in use of a circuit configuration, as in FIG. 13; and modulates the digital video data RiGiBi with a fifth compensation value stored at the memory 3 in accordance with the brightness analysis result to increase the brightness value of the digital video data RiGiBi, which are to be displayed at a bright image part, but to decrease the brightness value of the digital video data RiGiBi, which are to be displayed at a relatively dark image part. The fifth compensation values are determined to be values which correspond to the output gray levels of data stretching curves of various shapes for reinforcing the brightness and contrast of each gray level section. Herein, the third modulation part 21 modulates the digital video data RiGiBi with the fifth compensation values of the data stretching curve of which the gradient is high in the gray level section on which the digital video data RiGiBi are concentrated in the gray level distribution of one screen and of which the gradient is low in the gray level section where the distribution of the digital video data RiGiBi is relatively low. At the same time, the third modulation part 21 controls the brightness of the backlight unit of the liquid crystal display device in accordance with the brightness analysis result so that the brightness of a backlight light source which irradiates light on the bright image part is increased but the brightness of the backlight light source which irradiates light on the relatively dark part. As a result, the third modulation part 21 modulates the brightness of the digital video data RiGiBi in accordance with the image analysis result and increases the brightness and the contrast of the display image by controlling the backlight brightness at the same time, thereby increasing a dynamic contrast ratio in a motion picture.

The fourth modulation part 22 compensates the brightness of the digital video data AI(RGB), which are to be displayed at a panel defect surface, the backlight bright line and the link sub-pixel among the digital video data AI(RGB) inputted from the third modulation part 21, in use of the compensation values stored at the memory. The fourth modulation part 22 is substantially the same as the circuit configuration and operation of the second modulation part 2 of the foregoing first embodiment, thus a detail description for this will be omitted.

FIG. 13 is a diagram representing a circuit configuration of the third modulation part 21, in detail.

Referring to FIG. 13, the third modulation part 21 includes a brightness/color separating part 211, a delaying part 212, a brightness/color mixing part 213, a histogram analyzing part 215, a data processing part 214 and a backlight controller 216.

The brightness/color separating part 211 divides the digital video data RiGiBi into a brightness component Y and a chromaticity component U, V. Herein, the brightness component Y and the chromaticity component U, V are each calculated by Mathematical Formulas 6 to 8.

$$Y=0.299\times Ri+0.587\times Gi+0.114\times Bi \quad \text{[Mathematical Formula 6]}$$

$$U=0.493\times(Bi-Y) \quad \text{[Mathematical Formula 7]}$$

$$V=0.887\times(Ri-Y) \quad \text{[Mathematical Formula 8]}$$

Figure 14:
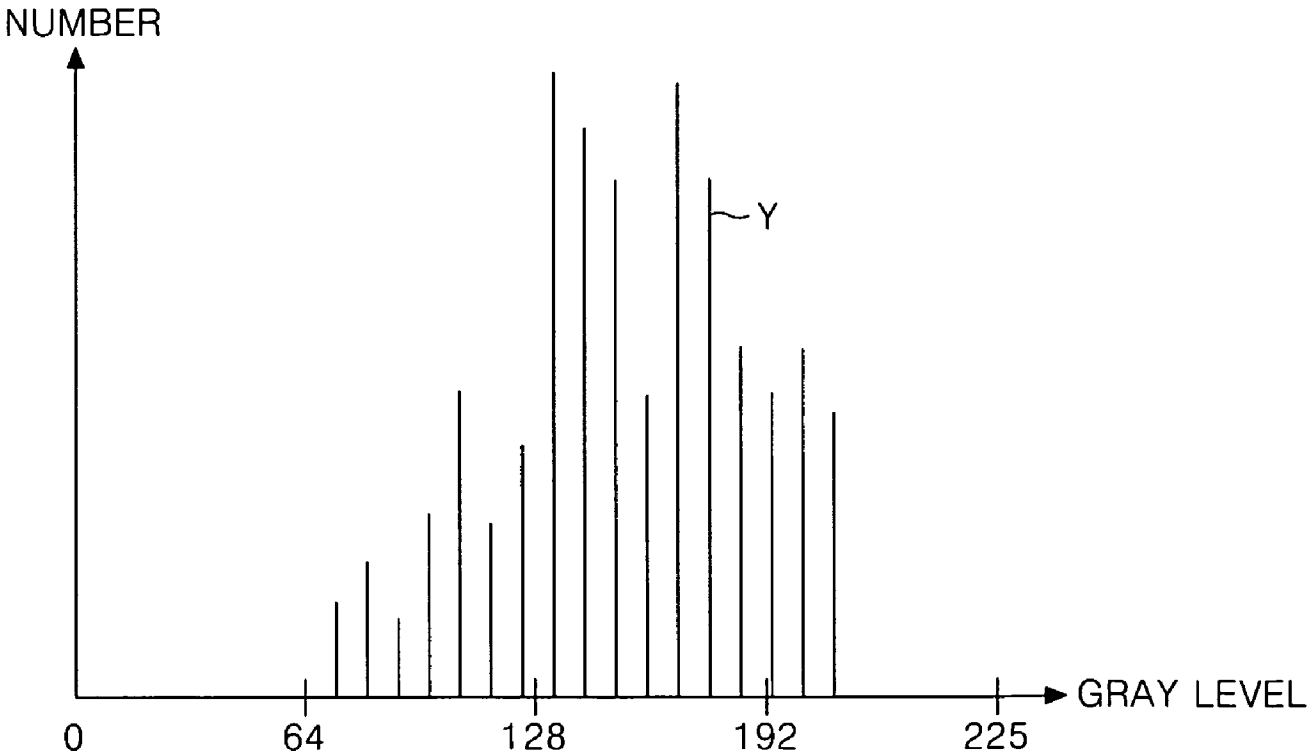
FIG. 14 is a graph showing an example of a histogram.

The histogram analyzing part 215 receives the brightness component Y separated by the brightness/color separating part 211 and sorts out the brightness component Y to an accumulative distribution function for each gray level, i.e., a histogram as in FIG. 14. Further, the histogram analyzing part 215 judges the display location of the digital video data RiGiBi in use of horizontal and vertical synchronization signals H, V and a clock signal CLK.

The data processing part 214 selectively modulates the brightness component Y of the input image in use of the fifth compensation value inputted from the memory 23 and the histogram analysis result inputted from the histogram analyzing part 215, thereby outputting the brightness component YM where contrast is selectively emphasized. There might be various methods of modulating the brightness component YM, and, for example, the methods proposed in U.S. patent application Ser. Nos. 10/747,690, 10/734,702 and the like which have been applied by this applicant might be used.

The delaying part 212 delays the chromaticity component U, V until the brightness component YM modulated in the data processing part 214 is generated, thereby synchronizing the modulated brightness component YM and the chromaticity component UD, VD which are inputted to the brightness/color mixing part 213.

The brightness/color mixing part 213 calculates the digital video data AI(RGB) to be supplied to the fourth modulation part 22 in use of Mathematical Formulas 9 to 11 below which take the modulated brightness component YM and the delayed chromaticity component UD, VD as variables.

$$R=YM+0.000\times UD+1.140\times VD \quad \text{[Mathematical Formula 9]}$$

$$G=YM-0.396\times UD-0.581\times VD \quad \text{[Mathematical Formula 10]}$$

$$B=YM+2.029\times UD+0.000\times VD \quad \text{[Mathematical Formula 11]}$$

The backlight controller 216 differently generates a dimming control signal Dim on the basis of the display location judgment result of each digital video data RiGiBi and the histogram analysis result inputted from the histogram analyzing part 215, thereby adjusting the brightness of the backlight light source which irradiates light on the display surface of the data where the contrast is emphasized by the data processing part 214.

An inverter 217 differently controls the duty ratio (or on and off ratio) of the drive AC power supplied to each of the backlight sources in accordance with the dimming control signal Dim, thereby differently controlling the backlight brightness in accordance with the brightness of the display image. The backlight light sources driven by the inverter 217 are realized of any one of a cold cathode fluorescent lamp CCFL, an external electrode fluorescent lamp EEFL and a light emitting diode LED or a combination thereof.

The modulation method of the third modulation part 21 has been explained in detail in U.S. patent application Ser. Nos. 11/022,688, 10/876,681, 11/288,262, 10/734,702, 10/880,392, 10/880,218, 10/879,852, 10/879,947, 10/880,321, 10/880,220 and the like which are proposed by this applicant, and all the modulation methods can be applied to the present invention.

Figure 15:
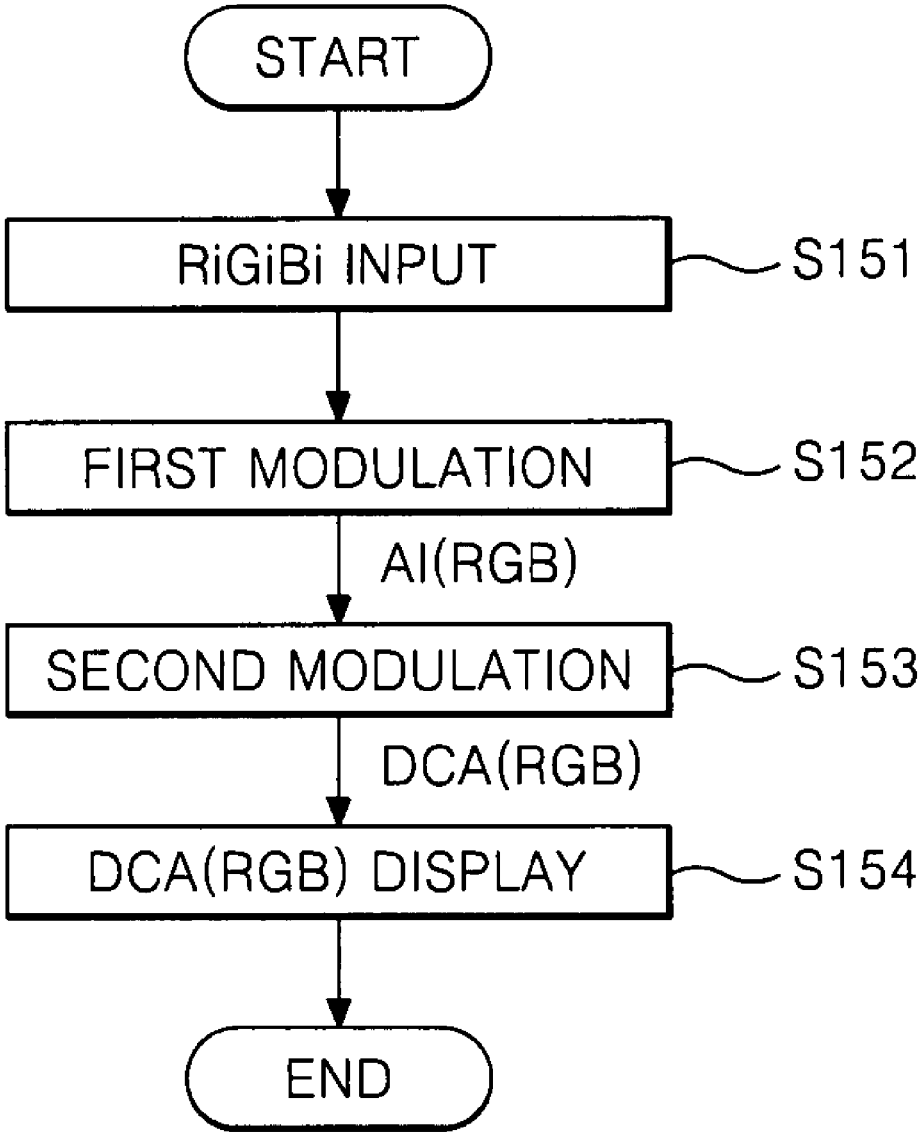
FIG. 15 is a flow chart representing a control sequence of the data multi-modulation method of the flat panel display device according to the second embodiment, step by step.

FIG. 15 is a flow chart representing a control sequence of the data multi-modulation method of the flat panel display device according to the second embodiment, step by step.

Referring to FIG. 15, the data multi-modulation method of the present invention analyzes the brightness in the image of one screen; primarily modulates the digital video data RiGiBi with a designated fifth compensation value for partially emphasizing the contrast in accordance with the analysis result; and generates the primarily-modulated digital video data AI(RGB) (S151, S152) And, the data multi-modulation method of the present invention secondarily modulates the digital video data AI(RGB), which are to be displayed at the display stain, the lamp bright line and the link sub-pixel among the primarily-modulated digital video data AI(RGB), with the designated second to fourth compensation values, thereby generating the secondarily-modulated digital video data DCA(RGB) (S153).

Lastly, the data multi-modulation method of the present invention converts the secondarily-modulated digital video data DCA(RGB) into the analog voltages or analog currents in accordance with the drive characteristic of the flat panel display panel, and then displays the picture by supplying the analog voltages or currents to the flat panel display panel (S154).

Figure 16:
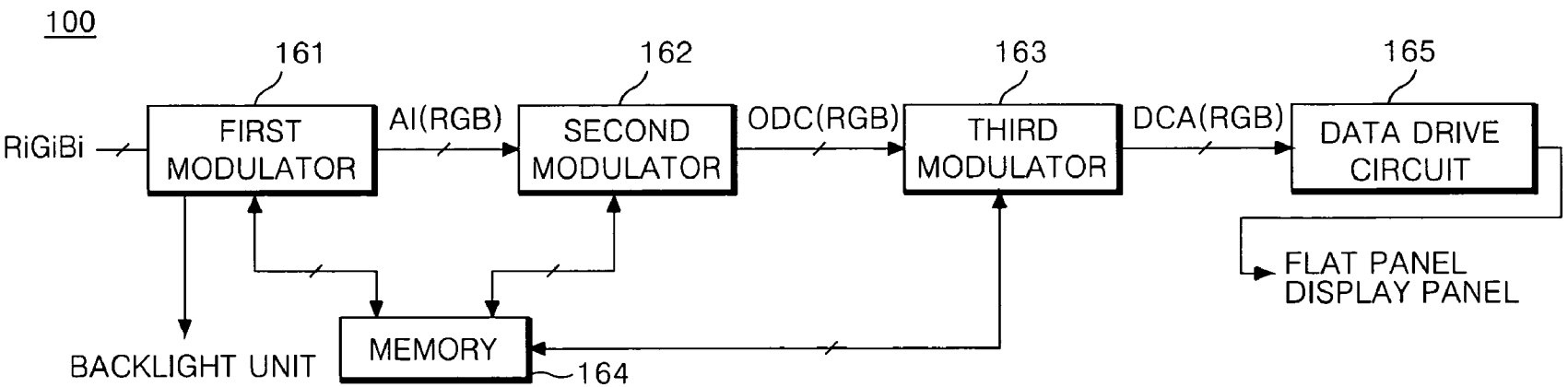
FIG. 16 is a block diagram representing a data multi-modulation device of a flat panel display device according to a third embodiment.

FIG. 16 represents a data multi-modulation device 100 of a flat panel display device according to a third embodiment.

Referring to FIG. 16, the data multi-modulation device 100 of the flat panel display device according to the third embodiment includes a first modulation part 161 which analyzes the brightness of the digital video data RiGiBi of one screen, primarily modulates the digital video data RiGiBi on the basis of the brightness analysis result, and adjusts the brightness of the backlight at the same time; a second modulation part 162 for secondarily modulating the digital video data RiGiBi for improving the response characteristic; a third modulation part 163 for thirdly modulates the digital video data ODC(RGB) which are to be displayed at the display stain, the lamp bright line and the link sub-pixel; a memory 164 for storing the location information and the compensation values required for the modulation parts 161, 162, 163; and a data drive circuit 165 for displaying the digital video data DCA(RGB) inputted from the third modulation part 163 in the flat panel display panel.

The memory 164 includes EEPROM and/or EDID ROM similarly to the foregoing embodiment, and stores the location information and the compensation values which are required for the data modulation of each of the modulation parts 161, 162, 163.

The first modulation part 161 is substantially the same as the third modulation part 21 shown in FIG. 12.

The second modulation part 162 secondarily modulates the primarily-modulated data AI(RGB), where the contrast is emphasized by the first modulation part 161, for increasing the response characteristic, in use of the same circuit configuration as the first modulation part 1 shown in FIG. 1.

The third modulation part 163 thirdly modulates the data ODC(RGB), which are to be displayed at the display stain, the lamp bright line and the link sub-pixel among the digital video data ODC(RGB) inputted from the second modulation part 162, in use of substantially the same circuit configuration as the second modulation part 2 shown in FIG. 1 and the fourth modulation part 22 shown in FIG. 12.

The data drive circuit 165 converts the digital video data DCA(RGB) inputted from the third modulation part 163 into the analog voltages or analog currents in accordance with the drive characteristic of the flat panel display panel, thereby supplying to the data lines of the flat panel display panel.

In order to prevent the brightness inversion phenomenon, the third modulation part 163 should perform the data modulation subsequently to the first and second modulation parts 161, 162, and the data modulation sequence of the first and second modulation parts 161, 162 can be changed.

Figure 17:
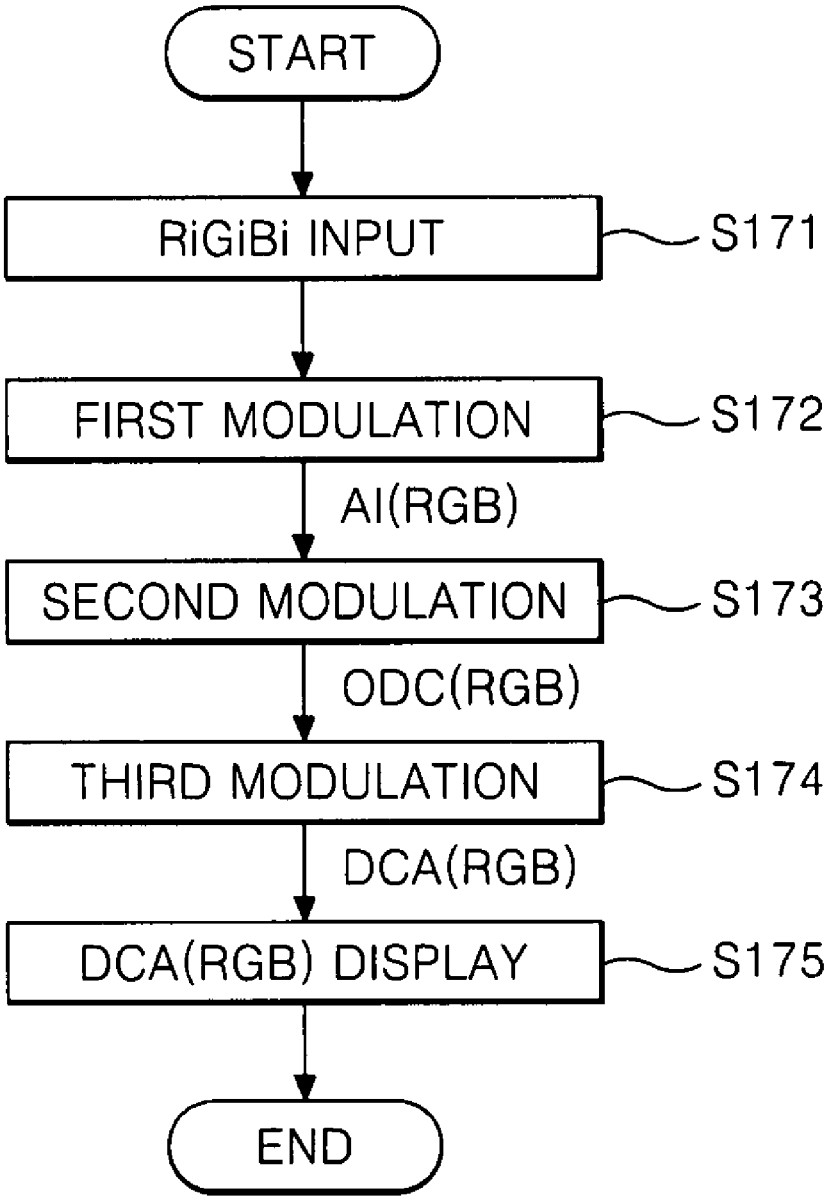
FIG. 17 is a flow chart representing a control sequence of the data multi-modulation method of the flat panel display device according to the third embodiment, step by step.

FIG. 17 is a flow chart representing a control sequence of the data multi-modulation method of the flat panel display device according to the third embodiment, step by step.

Referring to FIG. 17, the data multi-modulation method analyzes the brightness in the image of one screen, and primarily modulates the digital video data RiGiBi with a designated fifth compensation value for partially emphasize the contrast in accordance with the analysis result, thereby generating the primarily-modulated digital video data AI(RGB) (S171, S172). And, the data multi-modulation method of the present invention compares the presence or absence of a change and the extent of the change between the previous frame and the current frame for the primarily-modulated digital video data AI(RGB), and secondarily modulates the digital video data AI(RGB) in accordance with the comparison result, thereby increasing the response characteristic of the flat panel display panel for the data (S173).

Subsequently, the data multi-modulation method of the present invention thirdly modulates the digital video data ODC (RGB) which are to be displayed at the display stain, the lamp bright line and the link sub-pixel among the secondarily-modulated data ODC(RGB), thereby generating the thirdly-modulated digital video data DCA(RGB) (S174).

Lastly, the data multi-modulation method of the present invention converts the thirdly-modulated digital video data DCA(RGB) into the analog voltages or analog currents in accordance with the drive characteristic of the flat panel display panel, and then displays the picture by supplying the analog voltages or currents to the flat panel display panel (S175).

On the other hand, the memories 3, 23, 164 described in the foregoing embodiments are commonly connected to different modulation parts from each other, and can be connected to a ROM writer through a 4 pin, 6 pin or 30 pin user connector. Further, the ROM writer might be connected to a computer which has a user interface. Accordingly, the location information and the compensation values stored at the memory 3, 23, 164 can be modified by the user data supplied through the ROM writer and the user connector when modification is required because of the difference of fabrication process.

Figure 18:
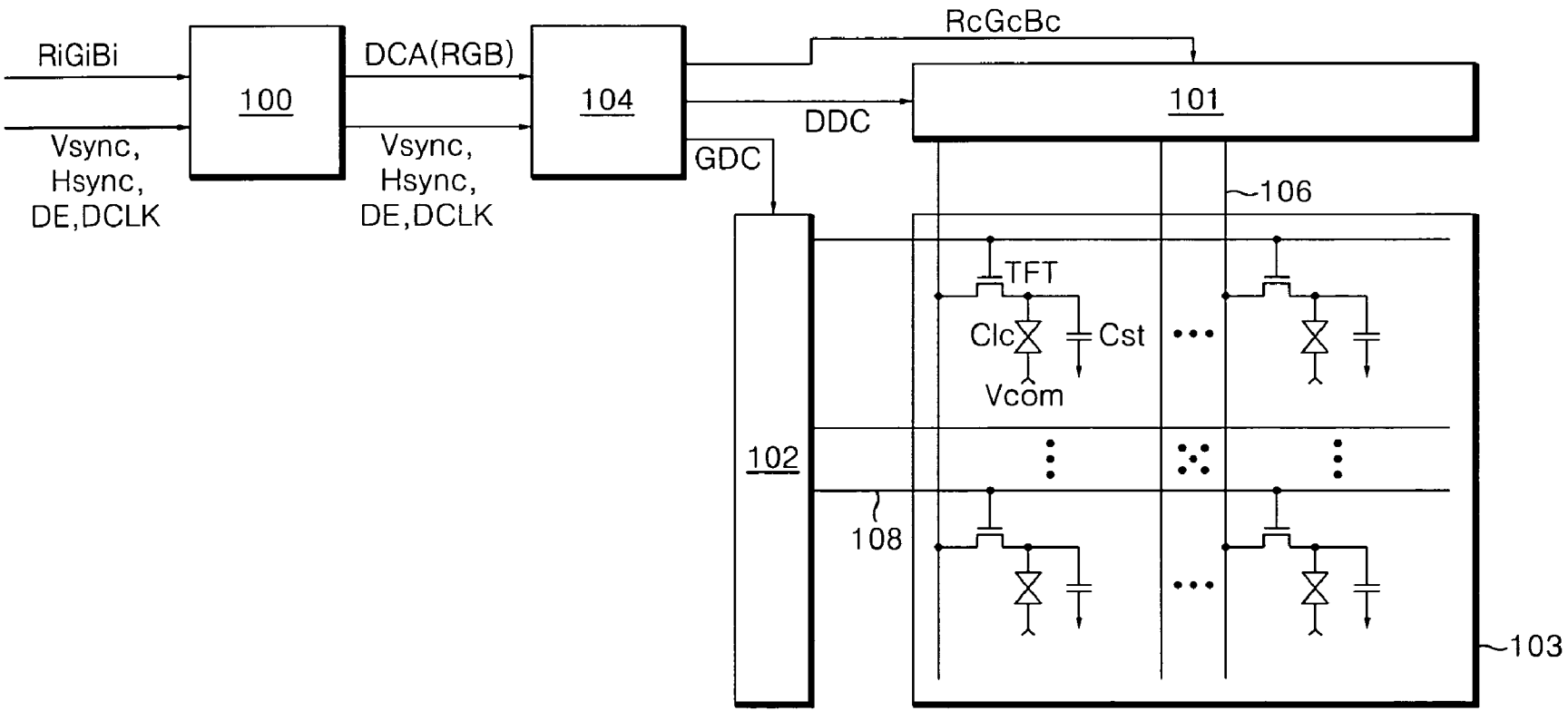
FIG. 18 represents a liquid crystal display according to an embodiment.

FIG. 18 represents a liquid crystal display device according to an embodiment.

Referring to FIG. 18, the liquid crystal display device includes a liquid crystal display panel 103 where data lines 106 cross gate lines 108 and thin film transistors TFT for driving liquid crystal cells Clc are formed at the crossing parts thereof; a data multi-modulation device 100 for modulating digital video data RiGiBi in use of location information and compensation values stored in advance; a data drive circuit 101 for supplying the compensated data DCA(RGB) to the data lines 106; a gate drive circuit 102 for supplying scan signals to the gate lines 106; and a timing controller 104 for controlling the drive circuits 101, 102.

The liquid crystal display panel 103 has liquid crystal molecules injected between two substrates, i.e., a TFT substrate and a color filter substrate. The data lines 106 and the gate lines 108 formed on the TFT substrate perpendicularly cross each other. The TFT formed at the crossing part of the data lines 106 and the gate lines 108 supplies data voltages, which are supplied through the data line 106, to a pixel electrode of the liquid crystal cell Clc in response to scan signals from the gate line 108. On the color filter substrate are formed a black matrix, a color filter and a common electrode (not shown). The common electrode can be formed on the TFT substrate in accordance with an electric field applying method. Polarizers having transmission axes which are perpendicular to each other are respectively stuck to the TFT substrate and the color filter substrate.

The data multi-modulation device 100 modulates the digital video data RiGiBi with different compensation values from each other for improving the response characteristic of the liquid crystal display panel 103 as well as partially emphasizing the contrast ratio in accordance with the image analysis result as described in the foregoing embodiments, and then performs the modulation for compensating the brightness of the data which are to be displayed at the display stain, the lamp bright line and the link sub-pixel.

The timing controller 104 supplies the digital video data DCA(RGB) from the data multi-modulation device 100 to the data drive circuit 101 in accordance with a dot clock DCLK, and generates gate control signals GDC for controlling the gate drive circuit 102 and data control signals DDC for controlling the data drive circuit 101 in use of vertical/horizontal synchronization signals Vsync, Hsync, a data enable signal DE and a dot clock DCLK. The data multi-modulation device 100 and the timing controller 104 can be integrated into one chip.

The data drive circuit 101 converts the digital video data DCA(RGB) supplied from the timing controller 104 into analog gamma compensation voltages, and supplies the analog gamma compensation voltages as data voltages to the data lines 106. The data drive circuit 101 is substantially the same as the data drive circuits 5, 25, 165 described in the foregoing embodiments.

The gate drive circuit 102 sequentially supplies scan signals, which select horizontal lines to which the data voltages are to be supplied, to the gate lines 108.

The liquid crystal display device can be applied to other flat panel display devices without a big change. For example, the liquid crystal display panel 103 can be replaced with a FED (field emission display), a PDP (plasma display panel), an OLED (organic light emitting diode) or the like.

As described above, the flat panel display device and the data multi-modulation method thereof performs the modulation for improving the response characteristic and the contrast ratio, and then performs the modulation for the data which are to be displayed at the display stain, the lamp bright line and the link sub-pixel, thereby making it possible to prevent the brightness inversion phenomenon that is generated when re-modulating the data previously modulated in the multi-modulation method.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device comprising:

a first modulator that primarily modulates digital video data, which are to be displayed in a liquid crystal display panel, with pre-stored first compensation values to adjust a contrast ratio of the liquid crystal display panel, wherein the first modulator analyzes a brightness of the digital video data, primarily modulates the digital video data with the first compensation values according to the brightness analysis result to increase the brightness value of the digital video data which are to be displayed at a bright image part, but to decrease the brightness value of the digital video data which are to be displayed at a relatively dark image part, and adjusts a brightness of a backlight unit according to the brightness analysis result;

a second modulator that inputs the modulated digital video data from the first modulator and secondarily modulates the modulated digital video data with pre-stored second compensation values in order to increase a response speed of liquid crystal of the liquid crystal display panel, wherein the second modulator compares the modulated digital video data of a previous frame with that of a current frame, selects the second compensation value according to the comparison result, and modulates the modulated digital video data with the selected second compensation value, wherein if the modulated digital video data of the current frame is larger than that of the previous frame, the modulated digital video data of the current frame is modulated with a value which is larger than that of the current frame, wherein if the modulated digital video data of the current frame is smaller than that of the previous frame, the modulated digital video data of the current frame is modulated with a value which is smaller than that of the current frame, and if the modulated digital video data of the current frame is the same as that of the previous frame, the modulated digital video data of the current frame is modulated with a value which is the same as that of the current frame; and a third modulator that inputs the secondarily-modulated digital video data from the second modulator and further modulates the secondarily-modulated digital video data, wherein the secondarily-modulated digital video data includes at least one of first and second video data, the first video data to be displayed at a defect display area of which the brightness appears different from that of a normal display surface when displaying the same gray level in the liquid crystal display panel, and the second digital video data to be displayed at a link sub-pixel to which a defect sub-pixel and an adjacent normal sub-pixel, having the same color as the defect sub-pixel, are electrically connected in the flat panel display panel, and wherein the third modulator modulates the first video data with pre-stored third compensation values and the third modulator modulates the second video data with a pre-stored fourth compensation value, wherein the third compensation values include an integer and a decimal fraction, which is determined according to a frame rate control method using dither patterns.

2. The liquid crystal display device according to claim 1, wherein the defect display area includes:

a first defect display area, which appears darker than the normal display surface; and a second defect display area, which appears brighter than the normal display surface.

3. The liquid crystal display device according to claim 2, wherein the third modulator adds the third compensation value to the modulated digital video data and subtracts the third compensation value from the modulated digital video data.

4. The liquid crystal display device according to claim 1, further comprising:

a memory for storing the first, second and third compensation values and the location information of the defect display area.

5. The liquid crystal display device according to claim 4, wherein the memory includes any one of EEPROM and EDID ROM.

6. The liquid crystal display device according to claim 1, further comprising:

a data drive circuit that converts the digital video data output from the third modulator into analog video signals and supplies the analog video signals to data lines of the flat panel display panel;

a scan driver circuit that supplies scan signals to the scan lines of the flat panel display panel; and a timing controller that controls the data drive circuit and the scan drive circuit and supplies the digital video data to the data drive circuit.

7. The liquid crystal display device according to claim 6, wherein the timing controller and the first, second and third modulators are integrated into one chip.

* * * * *